United States Patent [19]

Kussy

[11] Patent Number: 4,551,697

[45] Date of Patent: Nov. 5, 1985

[54] CURRENT LIMITING CIRCUIT BREAKER MECHANISM

[76] Inventor: Frank W. Kussy, 2A Willow Brook Ct., Randallstown, Md. 21133

[21] Appl. No.: 573,157

[22] Filed: Jan. 23, 1984

[51] Int. Cl.[4] ..... H01H 75/00

[52] U.S. Cl. ..... 335/16; 335/195

[58] Field of Search ..... 335/16, 195

[56] References Cited

U.S. PATENT DOCUMENTS 4,325,041 4/1982 Murai ..... 335/16

*Primary Examiner*—E. A. Goldberg

*Assistant Examiner*—George Andrews

[57] ABSTRACT

The invention concerns a very simple and effective current limiting circuit breaker of great versatility which is especially adaptable for motor control centers and combinations starters. That breaker can be used with various interchangeable trip units always with the same basic mechanism.

(a) for instantaneous trip type circuit breakers of various current ratings having high interrupting capacity and low $I^2t$ value to protect control equipment at high fault currents.

(b) for high interrupting capacity thermal magnetic circuit breakers at various current ratings.

(c) for circuit breakers with solid state tripping units to protect against overloads, short circuits, single phasing, underloads, etc.

10 Claims, 14 Drawing Figures

Figure 1A:
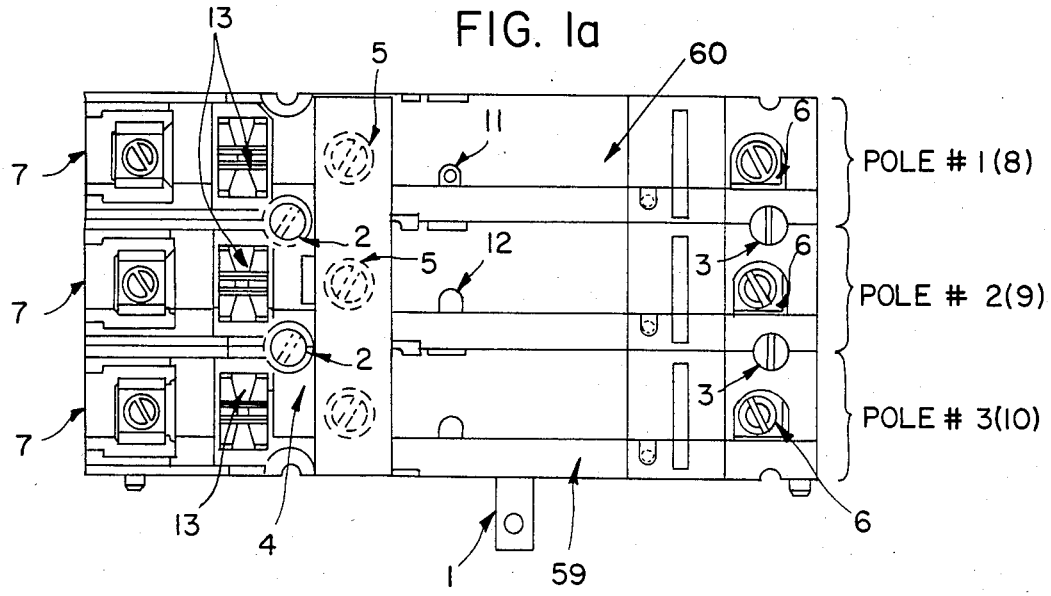

FIG. 2a
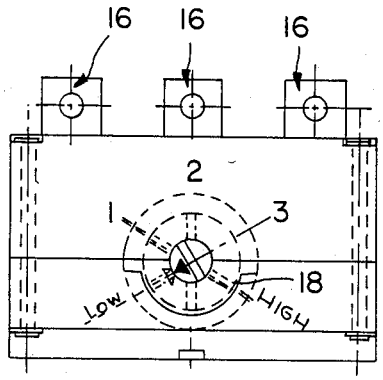
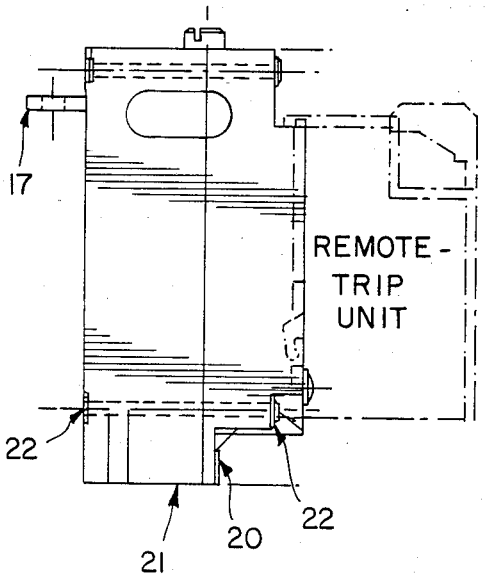
FIG. 2b
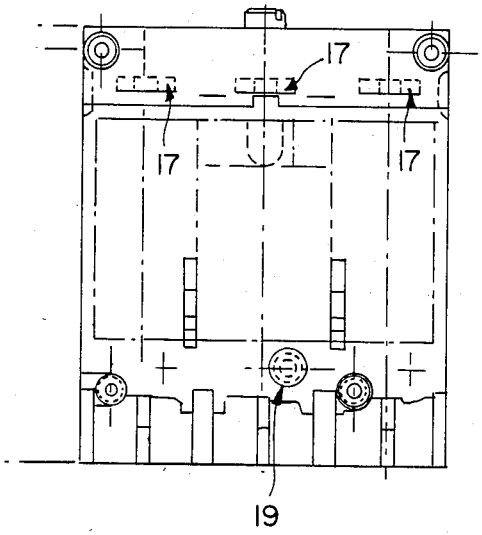
FIG. 2c

CURRENT LIMITING CIRCUIT BREAKER MECHANISM

BACKGROUND OF THE INVENTION

The basic invented breaker mechanism is an improvement of a mechanism until now used only for residential type circuit breakers. This mechanism could not be combined with the requirements for interrrupting high fault currents at high voltages (for example, 50 KA at 480 volts). It was further not available in combination with various trip units and industrial type handles.

The invention relates:

(a) The possibility to use this basic mechanism for current limiting action so obtaining industrial type high interrupting capacity circuit breakers for example 50 KA 480 volts. Such basic mechanism without the improvements is, for example, described in the book Elektrische Niederspannungs Schaltgerate by Kussy (Technischer Verlag Cram Berlin, 1969) on page 784. The mechanism has the advantage of great simplicity but in order to obtain current limiting action, the contact arms must be designed in such a way that the two arms or at least a large section of the arms be positioned parallel or nearly parallel in the closed position of the breaker with the current flowing in opposite direction in both arms, the arms having a close distance.

(b) A further improvement over the basic mechanism described by Kussy can be obtained by making the second contact arm also spring loaded so obtaining at higher fault currents an additional contact opening and increased opening speed because both contact arms are moving. The second contact arm can be under influence of a heavier spring than the first contact arm. That allows improved bouncing characteristic at the closing of the circuit breaker.

(c) The basic mechanisms described before was until now designed in such a way that the cradle was latched against a bimetal or magnet. The invented breaker latches the cradle against a lever which is pushed by a rotating teeter bar. This teeter bar is pushed by a magnet or a bimetal or a spring loaded lever operated by a magnetic latch (released permanent magnet). The rotating teeter bar is under influence of a small spring and may be used to push that armature of the magnetic latch toward the yoke of the permanent magnet by the unlatched cradle so that the circuit breaker can be later reset and latched by hand. This adaptation allows the mechanism to be used with interchangeable trip units.

(d) The contact blows open under heavy fault conditions before the breaker trips. Fast rebounding could cause welding and must be prevented. If the negative spring action and two moving contact arms do not already prevent reclosing it may be desirable to unlatch the cradle with a blown open contact arm. A further advantage of the invention is that such a current limiting circuit breaker therefore does not need an antirebound latch.

(e) The trip unit can be built in such a way that we can select trip units which trip first the one pole that carries the over current so requiring small tripping forces (adjustable magnetic trip unit or thermal trip unit) or use those which trip all poles at the same time by a cross-bar (solid state trip unit) in the trip unit.

(f) Another advantage of such a mechanism for industrial type breakers is that it can be used with an industrial type handle to secure positive action that means opening a welded contact by pushing directly the contact arm with the handle into the open position mechanically and not alone by a spring so securing that the contact arm moves to the full open position.

(g) Another advantage of the invention is that each pole is in a separate housing securing high strength, the cross-bar between poles not requiring an easily damageable cover such arrangement preventing a fault between poles due to hot gasses when interrupting high current.

These objects as well as others of this invention shall become readily apparent after reading the following description of the accompanying drawings in which show:

FIGS. 1*a,b* an outline of a basic three pole breaker unit

Figure 3B:
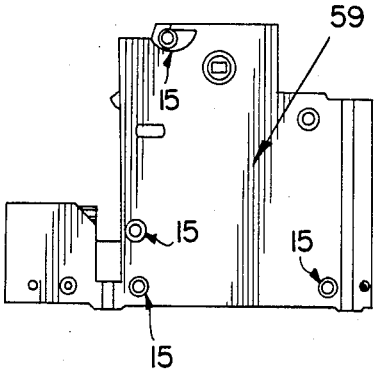
Figure 3A:
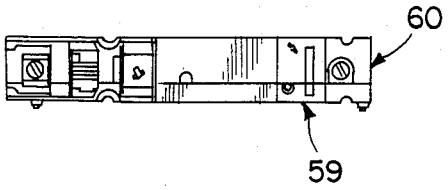
Figure 3C:
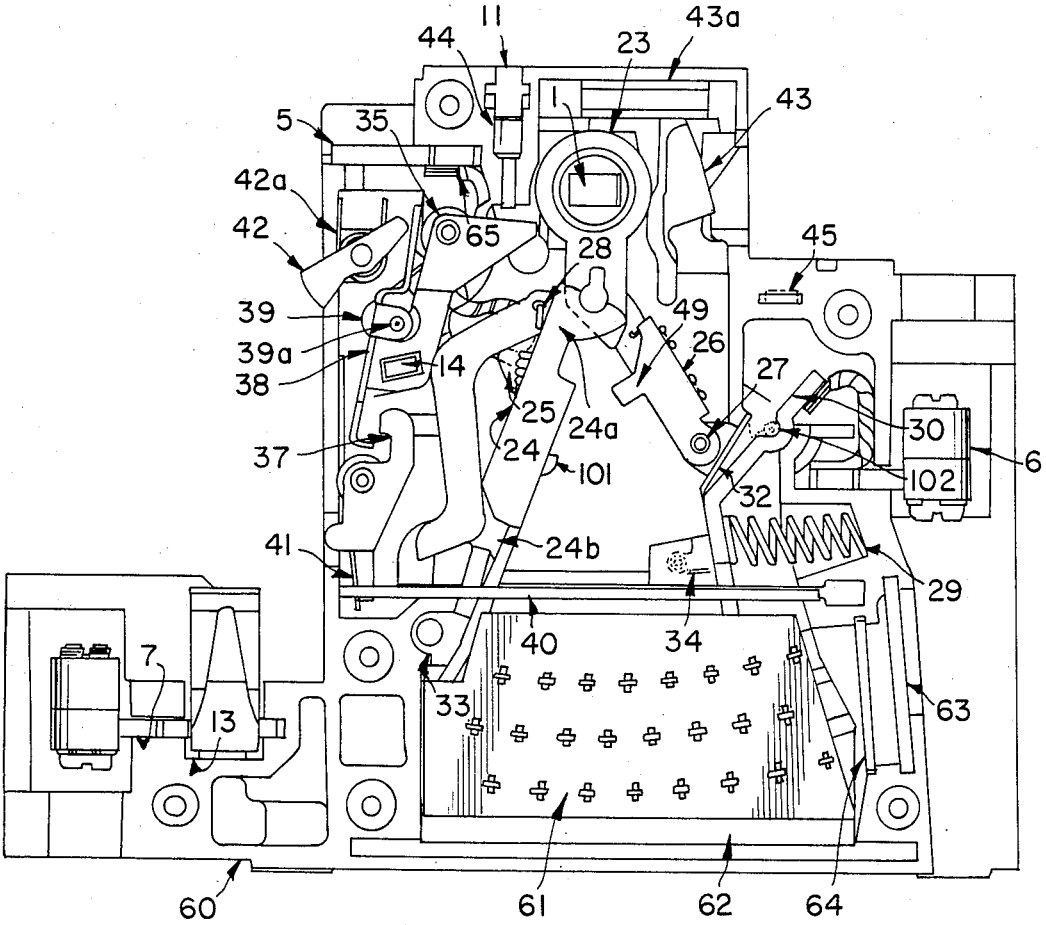
Figure 4:
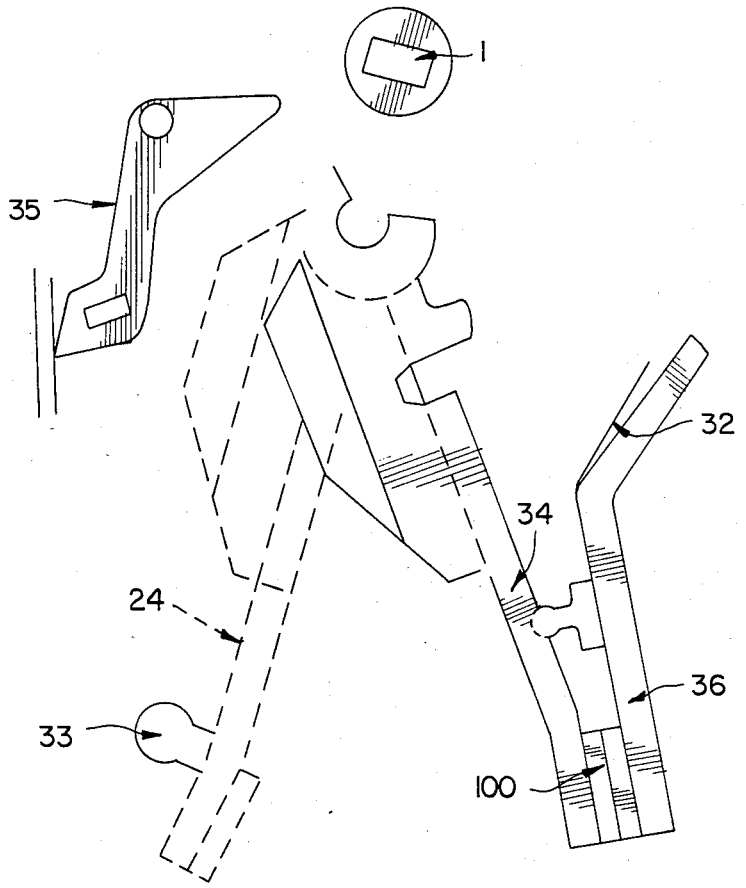
Figure 5:
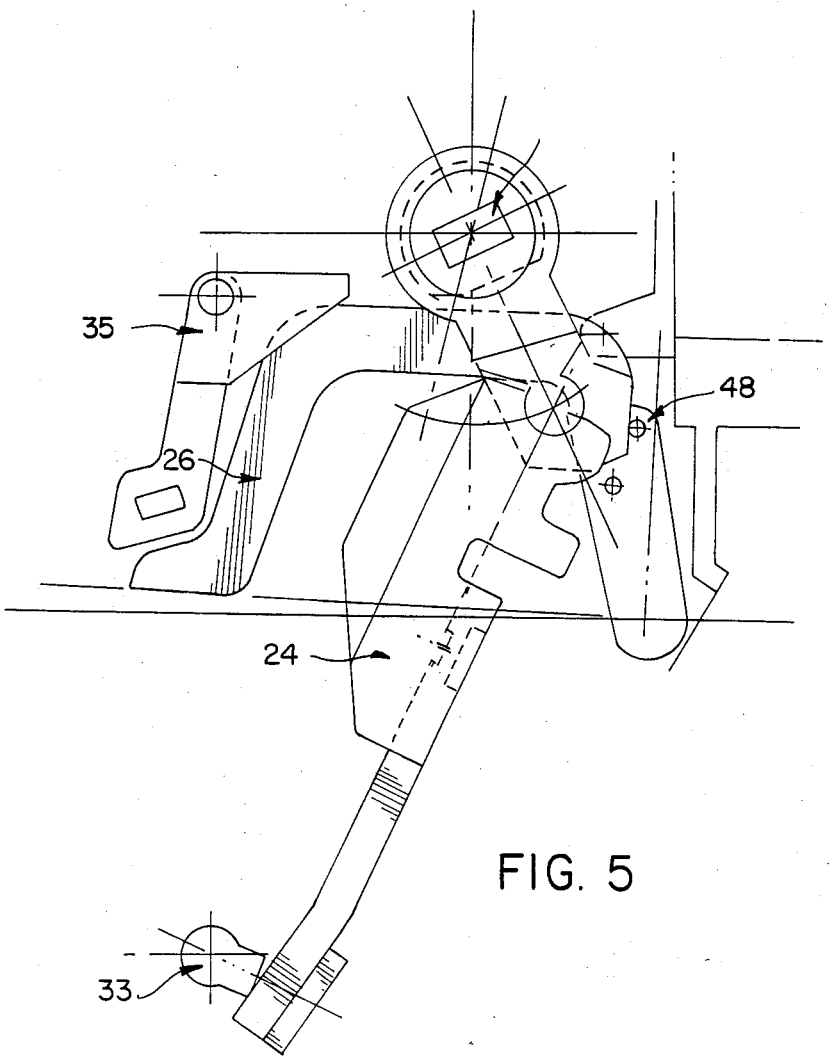
Figure 6:
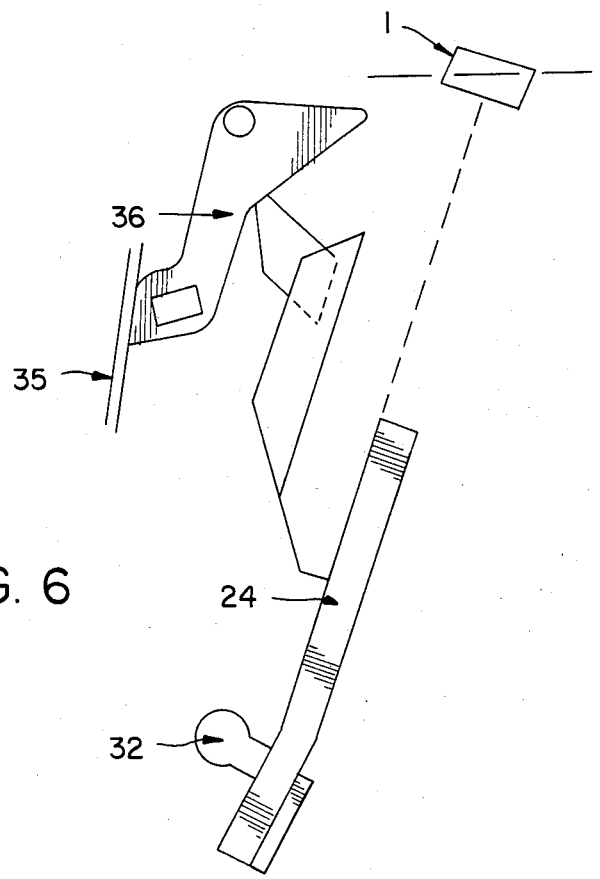
Figure 7:
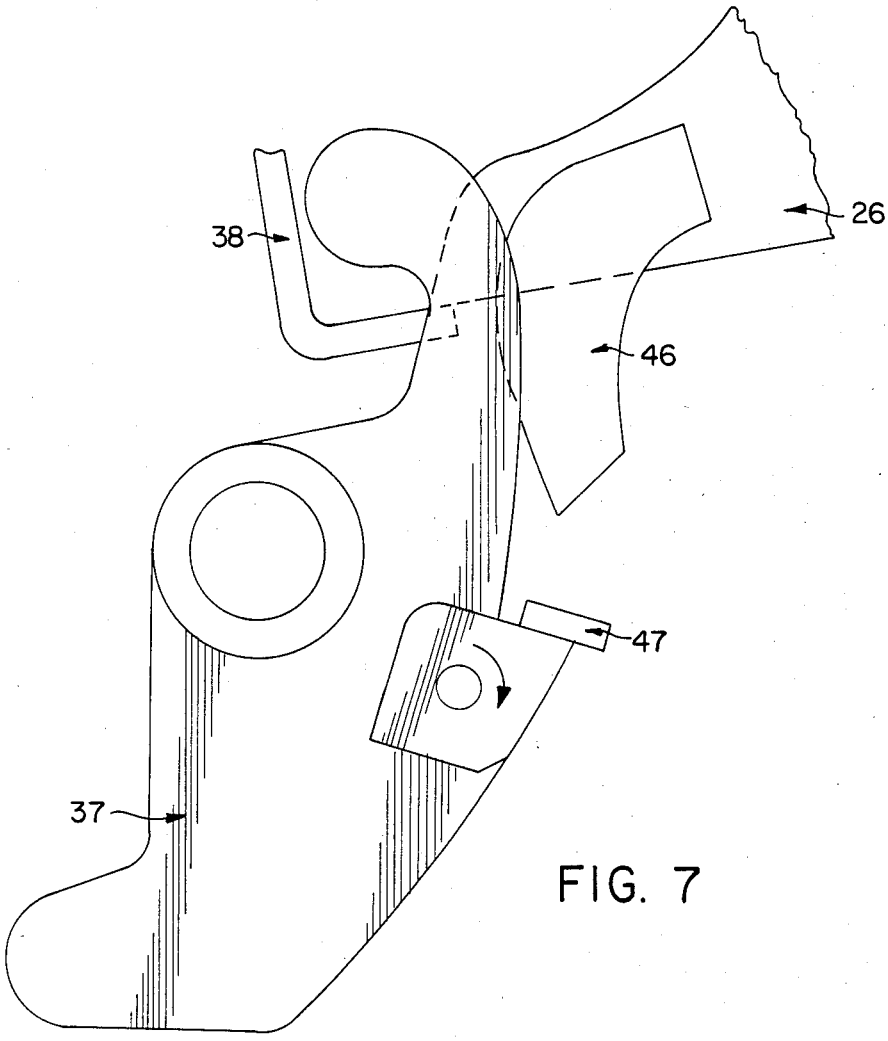
Figure 8A:
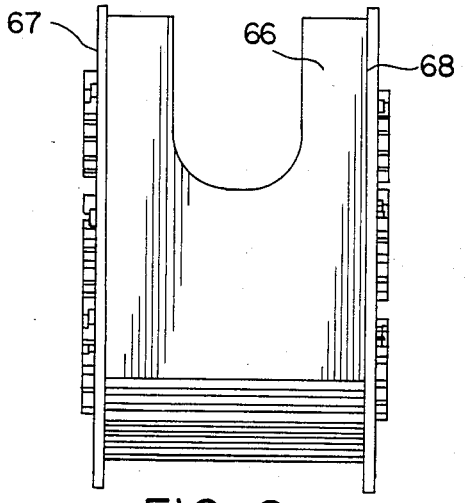

FIGS. 2*a,b,c* an outline of a three phase adjustable magnetic trip type interchangeable trip unit FIGS. 3*a,b,c* the mechanism of a single pole assembly in the trip position FIG. 4 the contact arrangement in the OFF position FIG. 5 the mechanism of a single pole in the ON position and in dotted lines in the blown open position FIG. 6 a contact arm arrangement in the blown off position in which the first movable contact arm pushes the trip lever to unlatch the cradle FIG. 7 a tripping mechanism different from FIG. 3 that resets the trip unit after the cradle is unlatched by moving the handle into the reset position FIGS. 8*a,b* an arc chamber for the circuit breaker.

Figure 1B:
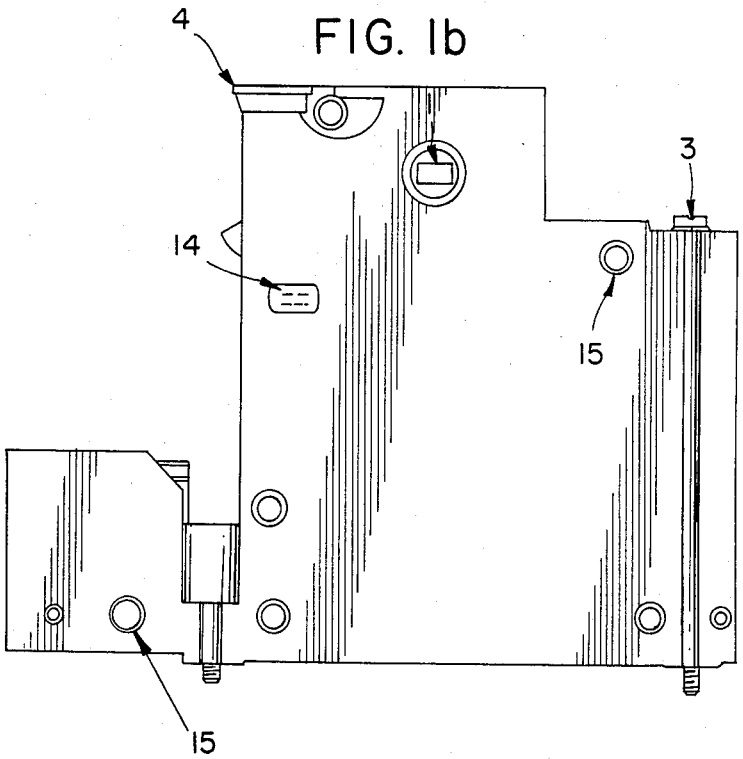

Now referring to the figures:

In FIG. 1, the metallic shaft 1 connects the three poles, 2 and 3 are mounting screws, 4 is a guard for the load side terminals 5 which connect to the trip unit here not drawn, 6 the line side, 7 the load side terminals of the breaker, 8, 9, and 10 are the three poles, 11 is the trip indicator, 12 the trip button, 15 are rivets, 13 plug in jaws, 14 the trip bar which after the first pole has tripped trips the other poles.

In FIG. 2 are 16 the line side terminals which are connected to the load side terminals 5 of the breaker mechanism, 17 are the three studs which can be plugged into the jaws 13. The positions 1, 2, 3 of adjustment knob 18 indicate the tripping current range of the trip unit, the dotted lines the position of the shunt trip which functions through hole 19 and the armature arm of the adjustable magnetic trip unit, 20 is the cover, 21 various base subassemblies for different current ranges, 22 tubular rivet assemblies.

In FIG. 3 is 23 a molded first lever which rotates with the shaft 1 (FIG. 1). This lever is a bearing for the first movable contact arm and provides the necessary clearing and air space to the shaft. The first movable contact arm 24 is divided in two sections 24*a* from the bearing point to the point where the tension spring is hooked into the contact arm and a section 24*b* between said point and the point of contact (FIGS. 4, 5). The point of contact 100 is not shown in FIG. 2. The pigtail 65 connecting 24 to 5 is partly shown. Contact spring 25 is held in cradle 26, cradle 26 turns around shaft 27. By turning shaft 1 we turn first lever 23 from the "ON" position (FIG. 4) to the "OFF" position (FIG. 5.) When the breaker trips the contact arm is in the position shown in FIG. 3. By turning from ON to OFF, we slide first the contact attached to arm 24 against the other contact until spring 25 crosses the center line, quick break is obtained. The center line is reached when the contact arm 24 and the hook 101 point of spring 25 and hole 28 in cradle 26 is in one line. A second movable contact arm 30 is pivoted around a shaft 102 and under influence of spring 29. A large section of this contact arm is in the closed position of the breaker approximately parallel to the section 24*b* of the first movable contact arm 24 with a partly shown pigtail, the second movable contact arm is connected to the line side terminal 6. An insulating barrier 32 separates the two contact arms. Not shown is a fixed L-shaped line side contact arm which could be used instead of the second movable contact arm for breakers having a somewhat lower interupting capacity. Compression spring 29 pushes the contact arm against a cushion 34 made, for example, of rubber. In case a fault current is interrupted, the contact arms 24 and 30 blow apart, the contact arm 4 is blown against an energy absorbing cushion 33. Generally, the presence of 33 and the second movable contact arm 30 are sufficient to avoid that the contacts reclose together before the breaker trips and therefore an antirebound latch is not necessary with this mechanism. In case that test results should show that a rebound of the contact arm with the consequence of contact welding under extremely high fault current occurs, a nose 36 could be attached to contact arm 24. This nose pushes trip lever 35 only in case the contacts blow open. The contact arm position for that case is shown in FIG. 6. When the trip unit functions teeter bar 37 is pushed by the not shown trip unit and turns latch lever 38, 38 is after unlatching cradle 26 turned back by spring 39, in catch spring cap 39A, teeter bar 37 pushes when operated trip plate 40 spring 41 resets 40 and 37. When the cradle collapses it pushes trip lever 35, 35 turns clockwise, it is connected through the trip bar 14 to the other poles. 14 is made of laminated material. Now the other trip levers 35 in the other poles move the latch lever in each pole unlatching the cradles in the other poles. This arrangement insures low tripping force and that the pole which is subjected to highest current trips first. In cases this feature is not desirable, for example, for solid state trip units having only one magnetic latch for all poles, the trip unit can be built with one tripper bar tripping all poles simultaneously.

The line side terminals of the trip unit 16 (FIG. 2) are fastened to the load terminals of the breaker mechanism 5 and the load side studs 17 of the trip unit to the jaws 13. The jaws are connected to the load side terminals 7 of the circuit breaker. A spring loaded (42A) lever 42 trips the breaker mechanism if the trip unit is removed. The upper right corner is a space for an auxiliary switch operated from the auxiliary switch lever 43 with guide plate 43A. The button with spring 44 serves to trip the breaker manually, 45 is a captive nut to attach the auxiliary switch. 59 is a cover for each pole. 60, the base (FIG. 1). 61 is the arc chute assembly. 62, the arc chute cover. 63, the metal screen. 64, the vented barrier.

FIG. 7 shows an alternate tripping mechanism. A second latch lever 46 is fastened to the cradle 26 when the lever 38 is turned by teeter bar 37 the cradle unlatches the latch lever 46 turns the teeter bar back by sliding over edge 47 which is held in one direction by the teeter bar 47 can turn counter clockwise against a not shown torsion spring. The teeter bar has a slight overtravel.

In any case the mechanism is reset by reengaging the cradle. The cradle is pushed back by turning the molded lever to the "OFF" or reset position, hereby resetting the cradle through reset pin 48 (FIG. 5).

A nose 49 at cradle pushes the movable contact arm 24 in case the contacts are slightly welded when the breaker trips.

Figure 8B:
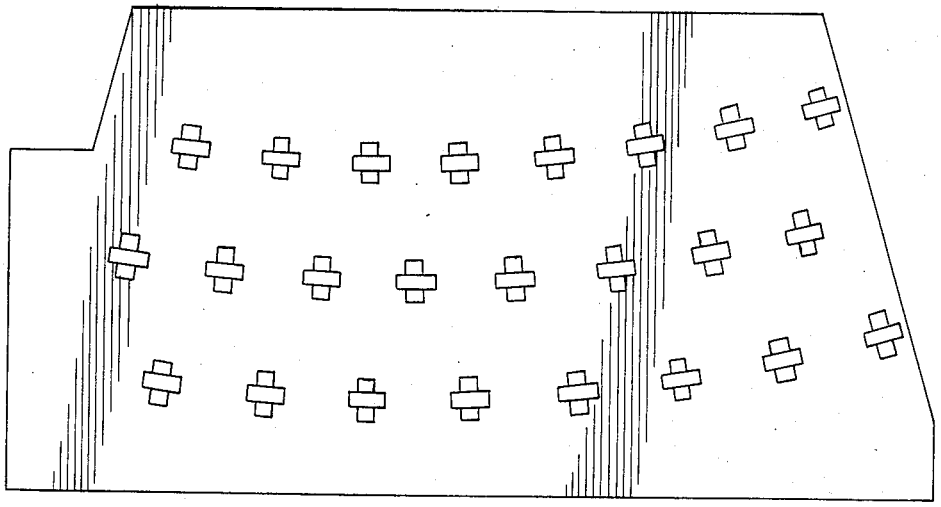

FIG. 8 shows the arc chute assembly 61 in greater detail. A large number of deion blades 66 are stacked between 2 cover plates 67 and 68 of insulating material, each blade is clamped on one side in the center slot on the other side in 2 slots.

Although there have been described preferred embodiments of this novel invention, many variations and modifications will now become apparent to those skilled in the art. Therefore, this invention is to be limited not by the specific disclosure herein but only by the appending claims.

What is claimed:

1. Multipole circuit breaker each pole having a mechanism consisting of a molded first lever operated by a metallic shaft, this shaft connecting all poles this shaft not needing an insulating cover, this first lever guiding when rotated a movable contact arm, this contact arm being under influence of an over the center spring, one end of this spring held in a cradle, a second end of this spring held in said movable contact arm, so dividing said contact arm in a first and second section, this first section being positioned between a first end of the movable contact arm and a hook of the spring where this first end can turn in said molded first lever and a second section of the movable contact arm which is positioned between the hook of the spring and a contact point, an approximately L-shaped fixed contact arm, one leg or at least a part of this leg being closely positioned to the second section of this movable contact arm or at least a large part of it, when the circuit breaker is in the "ON" position, and these two sections or at least parts of these two sections of the fixed and movable contact arms being approximately parallel, the current in these two sections flowing in opposite direction that the movable contact arm blows open by the electrodynamic forces at severe fault currents.

2. Multipole circuit breaker each pole having a mechanism consisting of a molded first lever operated by a metallic shaft, this shaft connecting all poles this shaft not needing an insulating cover, this first molded lever guiding when rotated the first movable contact arm, this contact arm being under influence of an over the center spring, one end of this spring held in a cradle, a second end of this spring held in said first movable contact arm, so dividing said contact arm in a first and second section, this first section positioned between the first end of this first movable contact arm and a hook of the spring where this first end can turn in said first molded lever and a second section of this first movable contact arm which is positioned betwen the hook of the spring and a contact point, a second movable contact arm, this second contact arm turning around a fixed point and being under influence of a second spring, this second spring held in the housing of the pole pushing against the second movable contact arm to a stop, this second movable contact arm having one leg or at least part of one leg closely positioned to said second section of the first movable contact arm or at least a large part of it, when the circuit breaker is in the "ON" position and these sections in the two contact arms being approximately parallel that both contact arms blow open by the electrodynamic forces at severe fault currents.

3. A circuit breaker mechanism as described in claim 2 influencing the second movable contact arm by a compression spring, this compression spring exerting at the contact considerably higher force than the tension spring at the first movable contact arm this compression spring force securing that the second movable contact does not move significantly when the circuit is closed by the first movable contact under normal conditions.

4. A circuit breaker described in claim 1 or 2 having a second pivotly mounted lever that serves to latch the cradle the cradle being pivoted around a fixed pivot and is under influence of the contact spring of this first movable contact arm, this second lever is being pushed for unlatching the cradle when the trip unit functions.

5. A circuit breaker pole as described in claim 2 having a large deion arc chamber with many deion blades, the number of active blades further enlarged when besides the first also the second movable contact arm under influence of the electrodynamic forces is repulsed at heavy fault current.

6. A multipole circuit breaker described in claims 1 or 2 having the basic mechanism in each pole placed in a nearly completely enclosed housing consisting of a molded base and cover part and separated from a nearly completely enclosed multipole trip unit so preventing that hot gases can cause a fault at the line side of the circuit breaker or enter the trip unit.

7. A multipole circuit breaker as described in claim 6 for each pole and a separately enclosed trip unit for all poles, this trip unit could be either of the adjustable magnetic, thermal magnetic or solid state trip type having either common tripper bar operating all poles simultaneously or operating only the pole which carries an overcurrent tripping of this pole is causing tripping of the other poles.

8. A multipole circuit breaker as described in claim 7, the trip unit added to the basic circuit breaker mechanism without taking the breaker apart by connecting the line side terminals of the trip unit to the load side terminals of the basic circuit breaker mechanism, these load side terminals are closely positioned to the front of the basic breaker mechanism, these terminals protected with a small removable cover.

9. Multipole circuit breaker each pole having a mechanism consisting of a molded first lever operated by a metallic shaft, this shaft connecting all poles, this shaft not needing an insulating cover, this first molded lever guiding when rotated the first movable contact arm, this contact arm being under influence of an over the center spring, one end of this spring held in a cradle, a second end of this spring held in said first movable contact arm, so dividing said contact arm in a first and second section, this first section positioned between the first end of this first movable contact arm and a hook of the spring where this first end can turn in said first molded lever and a second section of this first movable contact arm which is positioned between the hook of the spring and a contact point, a second movable contact arm, this second contact arm turning around a fixed point and being under influence of a second spring, this second spring held in the housing of the pole pushing against the second movable contact arm to a stop, this second movable contact arm having one leg or at least part of one leg closely positioned to said second section of the first movable contact arm or at least a large part of it, when the circuit breaker is in the "ON" position and these sections in the two contact arms being approximately parallel that both contact arms blow open by the electrodynamic forces at severe fault currents, said circuit breaker having a second spring loaded pivotly mounted lever, said lever serving to latch the cradle and is operable by a spring loaded teeter bar in order to unlatch the cradle, that teeter bar being pushed back by the collapsing cradle, to reset a magnetic latch in the trip unit.

10. Multipole circuit breaker each pole having a mechanism consisting of a molded first lever operated by a metallic shaft, this shaft connecting all poles, this shaft not needing an insulating cover, this first molded lever guiding when rotated the first movable contact arm, this contact arm being under influence of an over the center spring, one end of this spring held in a cradle, a second end of this spring held in this first movable contact arm, so dividing said contact arm in a first and second section, this first section positioned between the first end of said first movable contact arm and a hook of the spring where this first end can turn in said first molded lever and a second section of this first movable contact arm whch is positioned between the hook of the spring and a contact point, a second movable contact arm, this second contact arm turning around a fixed point and being under influence of a second spring, this second spring held in the housing of the pole pushing against the second movable contact arm to a stop, this second movable contact arm having one leg or at least part of one leg closely positioned to said second section of the first movable contact arm or at least a large part of it, when the circuit breaker is in the "ON" position and these sections in the two contact arms being approximately parallel that both contact arms blow open by the electrodynamic forces at severe fault currents, said circuit breaker having a second springloaded pivotly mounted lever, said lever serving to latch the cradle, said springloaded lever is pushing against its spring force when the first movable contact blows to the open position under influence of the dynamic force, between contact arms under severe fault conditions before the short circuit protective trip unit trips so preventing rebounding the first movable contact arm.

* * * * *